United States Patent [19]

Hull

[11] Patent Number: 4,790,091

[45] Date of Patent: Dec. 13, 1988

[54] YARD SIGN

[76] Inventor: Jack W. Hull, 24476 Via Secreto, El Toro, Calif. 92630

[21] Appl. No.: 67,319

[22] Filed: Jun. 26, 1987

Related U.S. Application Data

[63] Continuation-in-part of Ser. No. 715,406, Mar. 25, 1985, Pat. No. 4,685,233.

[51] Int. Cl.[4] ..... G09F 15/00

[52] U.S. Cl. ..... 40/607; 40/605

[58] Field of Search ..... 40/607, 602, 606, 605, 40/611

[56] References Cited

U.S. PATENT DOCUMENTS

| | | | |
|---|---|---|---|
| 2,573,413 | 10/1951 | Duncan | 40/607 |
| 3,552,702 | 1/1971 | Springer | 40/607 |
| 4,068,398 | 1/1978 | Parisi | 40/607 |
| 4,209,927 | 7/1980 | Donatelle | 40/607 |
| 4,263,738 | 4/1981 | Donatelle | 40/606 |
| 4,334,374 | 6/1982 | Spamer et al. | 40/606 |
| 4,408,407 | 10/1983 | Bloom et al. | 40/607 |
| 4,516,344 | 5/1985 | Seely | 40/602 |
| 4,548,377 | 10/1985 | Huel | 40/607 |
| 4,685,233 | 8/1987 | Hull | 40/607 |

FOREIGN PATENT DOCUMENTS

| | | | |
|---|---|---|---|
| 947357 | 1/1964 | United Kingdom | 40/606 |

*Primary Examiner*—Gene Mancene
*Assistant Examiner*—Cary E. Stone
*Attorney, Agent, or Firm*—Martin Faier

[57] ABSTRACT

A portable yard sign has an upstanding rigid post with a longitudinal slot extending downwardly from its top edge, and a main sign panel having a foldable side edge corresponding to and insertable into the slot for securing the panel to the post. The post on its bottom end may have a ground stake and foot plate assembly for penetration into a soil bed upon application of foot pressure on the plate. The panel remote from its side edge is free of connection to the post and is bendable at the side edge responsive to wind and other pressure against the panel. The slot may be arranged on one side of the post and the post may be triangular in cross-section. The panel side edge is of a width suitable to permit it to be lodged against the post when it is secured in the post slot.

18 Claims, 1 Drawing Sheet

YARD SIGN

PRIOR APPLICATION

This application is a continuation-in-part of my prior co-pending application Ser. No. 06/715,406, filed Mar. 25, 1985, for a PORTABLE YARD SIGN now U.S. Pat. No. 4,685,233.

BACKGROUND AND SUMMARY OF THE INVENTION

This invention relates to yard signs, such as outdoor signs used by real estate firms to inform the public of the availability of a property, or by a service station to advertise a temporary special sale, or the like.

Such signs must be easy to store, transport and assemble by an unskilled person without any special tools or equipment. Preferably, the sign must be capable of being handled in a flat condition so that its components may be simply stacked and carried. Assembly should involve only minimal manipulation of sign components and be without opportunity for misadjustment, and assembly must be simple enough to complete the job quickly at the site by an unskilled person. Additionally, the sign must be able to withstand extreme weather changes, particularly high winds. The sign must also be durable and able to resist all but the most violent of collisions without damage.

Installation and removal of the sign panel and post must be easily accomplished. Preferably, the sign panel should be easily installed and removed from the post, and the post should be easily installed in a yard by just foot pressure and removed by just rocking and pulling it from the earth, all by a person of moderate size and strength without tools or special training, and even under difficult weather conditions.

The sign embodying the present invention meets the above mentioned criteria. The sign post can be just a length of rigid hollow tubing, with a longitudinal slot formed on its edge from one end, and a ground stake and foot plate assembly is secured to the opposed end of the tubing. The sign panel is preferably a sheet of plastic, such as polyethylene or other similar polymer material which may be suitable for decorating and capable of withstanding severe weather conditions. Preferably, the sign panel may be fabricated from a single sheet of plastic material and heat scored on one edge to form a self-hinge. The panel may also be laminated from a plurality of similar or dissimilar plastic sheets.

The sign post may have a rectangular or triangular cross section, and the longitudinal slot may be formed by slitting or other conventional means along the post. This slot may be formed in a corner of a post having a rectangular cross section or in the center of the wall of a post having a triangular cross section. Preferably, whichever cross section arrangement is used, the width of the panel edge, from its edge to the hinge, should be less than but substantially similar in length to the distance from the inside corner of the post opposite the entry slot to another corner of the post, so that the sign edge when folded will lodge in a wedged manner within the post.

The plastic sign panel should be adequately rigid to extend or hang flag-like from the post, but of sufficient resiliency to allow for windspill when pressure against the sign builds up and of adequate memory to return to extended position. Likewise, the sign panel must be able to withstand less than violent collisions and return to extended position. The binding of the sign panel in the post must be sufficient along the panel folded edge to hold the sign panel on the post. The folded edge of the panel should be manipulated against the main sign panel body to permit easy insertion into and withdrawal from the tubular area of the post, but once in position the folded edge should flex free against the wall of the tubular post to prevent unintended withdrawal of the sign from the post.

Sign panels may be laid flat on one another for easy storage and transport, and may be interchangeable on the posts. The entire sign may be assembled without any tools or special equipment, and no special equipment is necessary for installation or removal of the sign. The sign may be erected and removed by any unskilled person.

The sign embodying the present invention is essentially impervious to weather. The sign panel will not rot, scratch, rust or become dirty, and may be cleansed by each rain or snow fall. The post may be fabricated from metal or plastic and may be coated or uncoated. Preferably, the post is closed by a movable cap to finish its free end. Preferably the post comprises a tube-like structure, but a channel-like structure will also perform in the inventive combination. The sign is lightweight, portable and capable of easy assembly and firm anchoring. In some circumstances, the post may be secured to its supporting surface by means of a stand or other fastening means, without anchoring by means of the foot plate and stake assembly disclosed in this application.

OBJECTS AND ADVANTAGES OF THE INVENTION

It is the object of the present invention to provide a yard sign of the character referred to.

Another object is to provide a novel slotted post and hinged sign panel assembly for a yard sign.

Another object is to provide a hinged panel edge on a sign panel which is of a width suitable for wedged mounting through a slot formed in a sign post.

Another object is to provide a novel sign panel secured on an upright post having a hinged end for securing the panel on the post and a free end adapted to flex responsive to wind and other pressures and to resume its posture prior to flexing after such pressures are exerted against the sign panel.

Another object is to provide an upright tubular post having an angular cross section and a slot extending from one end of the post into which a sign panel having a bendable edge may be wedged.

Another object is to provide a tubular post and sign panel assembly wherein the post has walls extending angularly from one another and a slot for securing the panel extends from one end of the post along an edge adjacent said angular walls.

Another object is to provide a post of triangular cross section and a sign panel secured in a slot extending from one end of the post in a wall of said post opposed to the edge between two of such walls and the panel has a foldable edge which may be wedged in said post.

Another object is to provide a novel plastic sign panel having a foldable edge defined by a score in the panel, and a post having a slot into which the panel and foldable edge are inserted and the panel is secured in the post slot by lodging the foldable edge against a wall of the post.

Another object is to provide a foldable edge on a sign panel which may be compressed to insert the panel into or withdraw the panel from a slot formed in an upright post.

Another object is to provide a yard sign which is durable and capable of withstanding wind and other pressures.

Another object is to provide a yard sign which is simple to assemble and take apart and to install and remove without special tools or skills.

Another object is to provide a portable yard sign which is simple and inexpensive to manufacture and very efficient in use.

These and other objects and advantages of the present invention will become more apparent as this description proceeds, taken in conjunction with the accompanying drawings.

DESCRIPTION OF PREFERRED EMBODIMENTS

Figure 1:
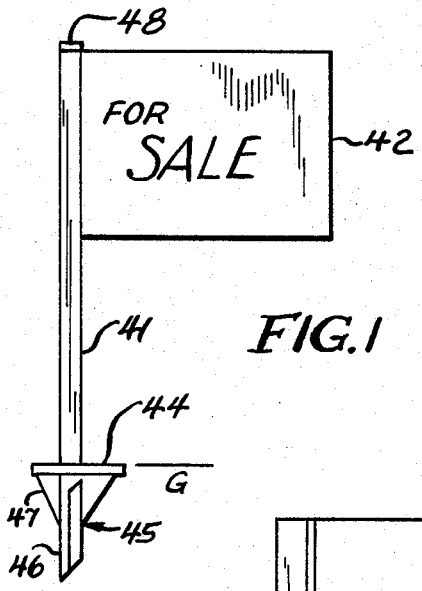
FIG. 1 is a side elevational view of the assembled yard sign embodying the present invention.
Figure 3:
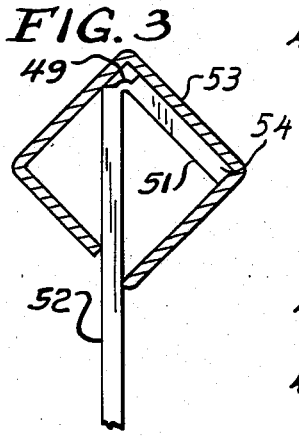
FIG. 3 is a cross-sectional view of the post and sign panel assembly taken on line 3—3 of FIG. 2.
Figure 2:
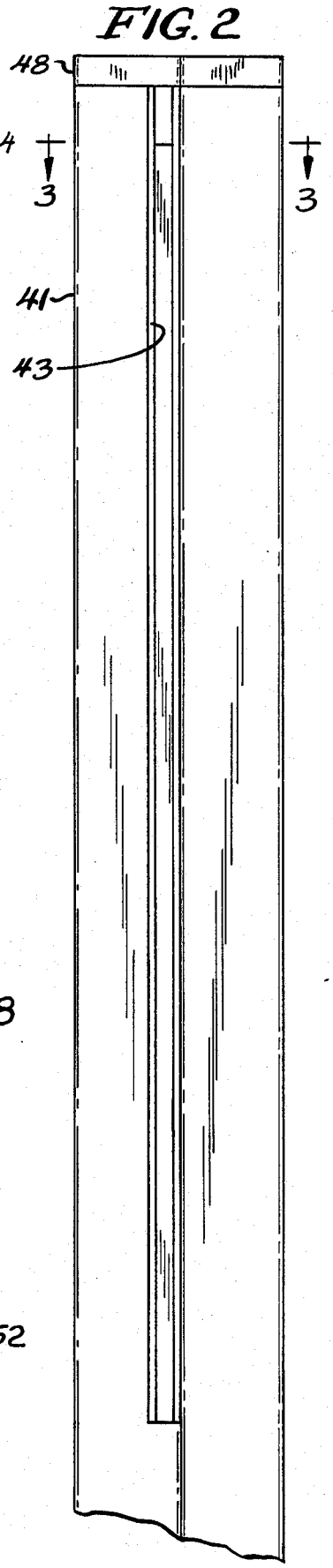
FIG. 2 is an enlarged side elevational view of the post and sign panel assembly, with parts broken away.

With reference to the yard sign shown in FIGS. 1-5, the device consists of an upright hollow post 41, from which a main sign panel 42 is extended, secured in slot 43 formed in the post. On the bottom of post 41 there may be secured an assembly for mounting the sign in a soil bed G, which consists of foot plate 44, from which depends a stake assembly 45, comprising a sharpened stake 46 and a reinforcement rib 47 connected to the foot plate 44. Plug 48 may be inserted into the open upper end of the post 41.

Figure 4:
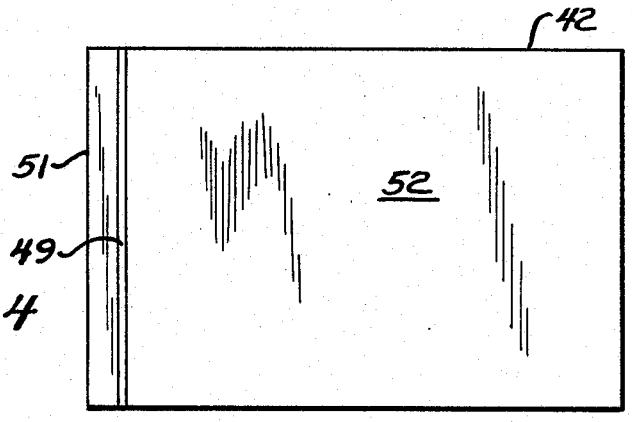
FIG. 4 is a plan view of the sign panel shown in FIGS. 1-3.
Figure 5:
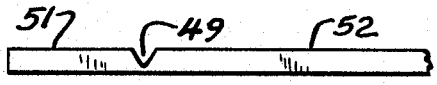
FIG. 5 is a side elevational view, with part of the main sign panel broken away, of the sign panel shown in FIG. 4.

As shown in FIGS. 4 and 5, one edge of the panel 42 is scored, as at 49, to define a hinge, separating the panel 42 into a main sign panel 52 and a hinge panel 51. This hinge panel 51 is dimensioned to bear against a related wall 53 of the post 41, preferably so that when the hinge panel 51 is allowed to flex free within the post it will wedge against the corner 54 of the wall 53 toward the slot 43.

Preferably, the sign panel 42 is fabricated from a sheet of polyethylene, which may easily be scored and hinged, which can accept suitable decoration, and which resists severe weather conditions. Also, the preferred sign panel material should have the ability to be self-hinged and to have inherent memory which will permit flexing at the hinge and flexing of the main sign panel 52 without damaging the material. Such flexing, when the panel 52 is held with the hinge 49 within the post, secured by the hinge panel 51, will allow the free end of the main sign panel 52 to spill wind and resist other pressures against the main sign panel without damage to it or loss of its securement on the post.

Figure 6:
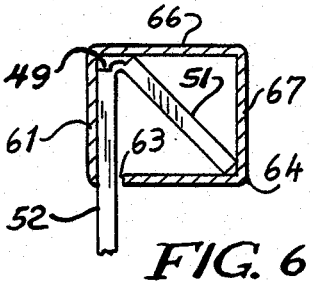
FIG. 6 is a modification of the post, taken in a position similar to the embodiment shown in FIG. 3.

With reference to FIG. 6, the post 61 is rectangular in cross-section. In this embodiment, the slot 63 is formed in a corner of the post, which permits the edge of the main sign panel 52 to bear against the post 61, and the edge panel 51 preferably spans the walls 66 and 67, and lodges wedge-like in the corner 64.

Figure 8:
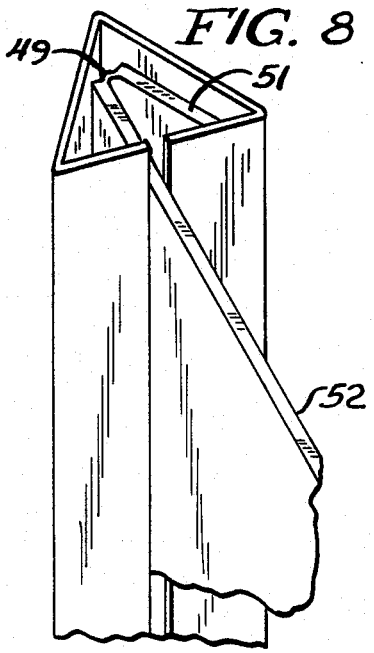
FIG. 8 is a perspective view, with part of the sign panel broken away, of the post and sign panel assembly shown in FIG. 7.
Figure 7:
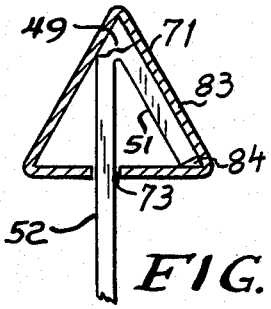
FIG. 7 is another modification of the post, taken in a position similar to the embodiment shown in FIG. 6.

With reference to the embodiment shown in FIGS. 7 and 8, the sign post 71 is triangular in cross section, and the slot 73 is formed preferably midway along one of its longitudinal walls 74. In this embodiment, the hinge 49 nests in the corner opposed to the slot 73 and the edge panel 51 lies against the wall 83, and wedged in the corner 84.

In each sign panel design, the edge panel 51 is bent along the hinge 49 to fit into a corresponding slot 43, 63 or 73 in the post, and when installed the sign panel 42 is secured in the slot by a wedge-like action between the main panel 52 and the edge panel 51 against a wall 53 or 83 or a corner 54, 64 or 84 of the post 41, 61 or 71, respectively. When it is desired to withdraw the sign panel 42 from the post 41, for example, in the FIGS. 1-5 embodiment, the edge panel 51 and the main panel 52 are merely flexed together, permitting the sign panel to be removed from its post, by sliding the sign out of the slot. So that the means for removal is not readily apparent, and the sign looks finished, the post may be capped with the cap 48 designed for easy insertion into and removal from the post 41.

While preferred embodiments of the invention have been shown and described in considerable detail, it is not intended that the invention should be limited to the exact construction disclosed, as many modifications may be made in the structures without departing from the scope or spirit of the invention.

I claim:

1. A yard sign, a rigid upstanding post, a slot on one side of and extending downwardly from the top of said post, mounting means remote from said post top for holding said post upright on a surface, and a sign panel, said panel comprising an indicia carrying member and edge member on one end of said panel, said indicia carry member having a free end extending from said edge member, said edge member being insertable into and removably secured in said post slot and having a width suitable for wedgelike lodgement in said post when inserted into said slot, said panel free end being free of connection to said post and flexible responsive to pressure applied against said panel, said edge member being insertable into and removable from said post slot upon bending said edge member against said indicia carrying member.

2. In the yard sign recited in claim 1, wherein said sign panel comprises a sheet of flexible plastic material.

3. In the yard sign recited in claim 2, wherein said sheet is polyethylene.

4. In the yard sign recited in claim 1, wherein said sign panel is scored on one face between said indicia carrying member and said edge member to define a hinge between said members.

5. In the yard sign recited in claim 1, wherein said edge member is foldable against said indicia carrying member during insertion of said edge member into said slot.

6. In the yard sign recited in claim 1, wherein said edge member is urged against said post when inserted into said slot.

7. In a yard sign, a rigid upstanding channel-like post, a slot on one side of and extending downwardly from the top of said post, mounting means remote from said post top for holding said post upright on a surface, and a sign panel, said panel comprising an indicia carrying member and an edge member on one end of said panel, said indicia carrying member having a free end extending from said edge member, said edge member being insertable into said post slot and having a width suitable for wedgelike lodgement in said post when inserted into said slot, said panel free end being free of connection to said post and flexible responsive to pressure applied against said panel, said panel being scored on one face between said indicia carrying member and said edge member to define a hinge between said members.

8. In the yard sign recited in claim 7, wherein said post is rectangular in cross-section and said edge member bears against a side of said rectangular cross-section when said sign panel is mounted in said slot.

9. In the yard sign recited in claim 7, wherein said indicia carrying member is supported in extended position in said slot when said edge member is secured in said post.

10. In the yard sign recited in claim 7, wherein said slot is arranged in a wall of said post opposite said hinge when said sign panel is secured on said post.

11. In the yard sign recited in claim 7, wherein said mounting means comprises a foot plate and stake assembly.

12. In a yard sign, a rigid upstanding channel-like post, said post having a triangular cross-section, a slot on one side of said extending downwardly from the top of said post, mounting means remote from said post top for holding said post upright on a surface, and a sign panel, said panel comprising an indicia carrying member and an edge member on one end of said panel, said indicia carrying member having a free end extending from said edge member, said edge member being insertable into said post slot and having a width suitable for wedgelike lodgement within said post triangular cross section when inserted into said slot, said panel free end being free of connection to said post and said panel being bendable responsive to pressure applied against said panel and having memory to return to extended position absent such pressure.

13. In the yard sign recited in claim 12, wherein said slot is arranged longitudinally of said post along one side of said triangular cross-section midway its width.

14. In the yard sign recited in claim 13, wherein said edge member is arranged parallel to one of said sides.

15. In the yard sign recited in claim 13, wherein said indicia carrying member bisects said triangular cross-section.

16. In a sign panel for a yard sign having a rigid upstanding channel-like slotted post, said sign panel comprising an edge member on its one end and a member carrying indicia on an end opposite said edge member, the portion of said sign panel between said members being scored from side to side to define a hinge for folding said edge member against said indicia carrying member, said edge member and said indicia carrying member being adapted for removable securement in said post, said indicia carrying member being adapted for extension from said post slot when said members are secured in said post, said edge member having a width for wedged securement in said post when said panel is secured in said post slot and said edge member is folded toward said indicia carrying member.

17. In the sign panel recited in claim 16, wherein said members and hinge have memory urging said members into co-planar relationship.

18. In the sign panel recited in claim 16, wherein said hinge score is made on one surface of said sign panel.

* * * * *